US009777569B2

(12) United States Patent
Turley et al.

(10) Patent No.: US 9,777,569 B2
(45) Date of Patent: Oct. 3, 2017

(54) RUNNING TOOL

(71) Applicant: Weatherford Technology Holdings, LLC, Houston, TX (US)

(72) Inventors: Rocky A. Turley, Houston, TX (US); Robin L. Campbell, Webster, TX (US); Karsten Heidecke, Houston, TX (US); George Givens, Spring, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 602 days.

(21) Appl. No.: 14/082,996

(22) Filed: Nov. 18, 2013

(65) Prior Publication Data

US 2015/0136394 A1 May 21, 2015

(51) Int. Cl.

| | |
|---|---|
| ***E21B 43/10*** | (2006.01) |
| ***E21B 47/12*** | (2012.01) |
| ***E21B 23/00*** | (2006.01) |
| ***E21B 33/13*** | (2006.01) |

(52) U.S. Cl.

CPC ..... *E21B 47/12* (2013.01); *E21B 23/00* (2013.01); *E21B 33/13* (2013.01); *E21B 43/10* (2013.01)

(58) Field of Classification Search

CPC ..... E21B 43/10

See application file for complete search history.

(56) References Cited

U.S. PATENT DOCUMENTS

| | | | |
|---|---|---|---|
| 2,693,859 | A | 11/1954 | Wright |
| 4,405,017 | A | 9/1983 | Allen et al. |
| 4,583,593 | A | 4/1986 | Zunkel et al. |
| 4,893,678 | A | 1/1990 | Stokley et al. |
| 5,086,843 | A | 2/1992 | Mims et al. |
| 5,086,844 | A | 2/1992 | Mims et al. |
| 5,146,992 | A | 9/1992 | Baugh |
| 5,170,847 | A | 12/1992 | Mims et al. |
| 5,174,375 | A | 12/1992 | Mims et al. |
| 5,360,069 | A | 11/1994 | Schmuck et al. |
| 5,435,390 | A | 7/1995 | Baugh et al. |
| 5,553,667 | A | 9/1996 | Budde et al. |
| 5,560,426 | A | 10/1996 | Trahan et al. |
| 5,590,713 | A | 1/1997 | Baugh et al. |
| 5,787,979 | A | 8/1998 | Giroux et al. |
| 5,813,457 | A | 9/1998 | Giroux et al. |
| 5,833,002 | A | 11/1998 | Holcombe |
| 5,856,790 | A | 1/1999 | Baugh et al. |

(Continued)

FOREIGN PATENT DOCUMENTS

| | | | |
|---|---|---|---|
| GB | 2350141 | A | 11/2000 |
| WO | 2008/115944 | A2 | 9/2008 |
| WO | 2012/065126 | A2 | 5/2012 |

OTHER PUBLICATIONS

Weatherford—WellMaster All-in-One Deepwater System brochure, date unknown, 1 page.

(Continued)

*Primary Examiner* — John Kreck

(74) *Attorney, Agent, or Firm* — Patterson & Sheridan LLP

(57) ABSTRACT

A running tool for deploying a tubular string into a wellbore and methods for operating a wellbrore using the running tool are disclosed. The running tool includes a tubular body and a latch for releasably connecting the tubular string to the body. The running tool further includes a lock to keep the latch engaged.

9 Claims, 8 Drawing Sheets

(56) References Cited

U.S. PATENT DOCUMENTS

| | | | |
|---|---|---|---|
| 5,954,133 | A | 9/1999 | Ross |
| 6,009,944 | A | 1/2000 | Gudmestad |
| 6,053,244 | A | 4/2000 | Dybevik et al. |
| 6,056,053 | A | 5/2000 | Giroux et al. |
| 6,065,536 | A | 5/2000 | Gudmestad et al. |
| 6,241,018 | B1 | 6/2001 | Eriksen |
| 6,241,023 | B1 | 6/2001 | Krauss et al. |
| 6,244,350 | B1 | 6/2001 | Gudmestad et al. |
| 6,311,771 | B1 | 11/2001 | Gudmestad et al. |
| 6,318,472 | B1 | 11/2001 | Rogers et al. |
| 6,419,015 | B1 | 7/2002 | Budde et al. |
| 6,527,057 | B2 | 3/2003 | Fraser, III et al. |
| 6,561,270 | B1 | 5/2003 | Budde |
| 6,597,175 | B1 | 7/2003 | Brisco |
| 6,634,428 | B2 | 10/2003 | Krauss et al. |
| 6,789,619 | B2 | 9/2004 | Carlson et al. |
| 6,799,638 | B2 | 10/2004 | Butterfield, Jr. |
| 6,848,511 | B1 | 2/2005 | Jones et al. |
| 6,866,100 | B2 | 3/2005 | Gudmestad et al. |
| 6,966,368 | B2 | 11/2005 | Farquhar |
| 7,063,148 | B2 | 6/2006 | Jabusch |
| 7,066,256 | B2 | 6/2006 | Dillenbeck et al. |
| 7,114,573 | B2 | 10/2006 | Hirth et al. |
| 7,128,154 | B2 | 10/2006 | Giroux et al. |
| 7,165,622 | B2 | 1/2007 | Hirth et al. |
| 7,182,135 | B2 | 2/2007 | Szarka |
| 7,219,730 | B2 | 5/2007 | Tilton et al. |
| 7,252,152 | B2 | 8/2007 | LoGiudice et al. |
| 7,426,964 | B2 | 9/2008 | Lynde et al. |
| 7,537,060 | B2 | 5/2009 | Fay et al. |
| 7,581,595 | B2 | 9/2009 | Fay et al. |
| 7,584,792 | B2 | 9/2009 | Szarka |
| 7,686,092 | B2 | 3/2010 | Szarka |
| 7,766,088 | B2 | 8/2010 | Saucier et al. |
| 7,845,400 | B2 | 12/2010 | Smith, Jr. et al. |
| 8,276,665 | B2 | 10/2012 | Webb et al. |
| 8,286,717 | B2 | 10/2012 | Giroux et al. |
| 8,347,964 | B2 | 1/2013 | Fisher et al. |
| 8,479,808 | B2 | 7/2013 | Gouthaman |
| 8,651,174 | B2 | 2/2014 | Barbee et al. |
| 8,668,003 | B2 | 3/2014 | Osmundsen et al. |
| 8,881,824 | B2 | 11/2014 | Stautzenberger |
| 8,997,850 | B2 | 4/2015 | Barbee et al. |
| 9,004,179 | B2 | 4/2015 | Chauffe |
| 9,068,413 | B2 | 6/2015 | Doane |
| 9,068,414 | B2 | 6/2015 | Doane |
| 9,080,404 | B2 | 7/2015 | Kalb et al. |
| 9,121,232 | B2 | 9/2015 | Abraham et al. |
| 9,212,531 | B2 | 12/2015 | Robichaux et al. |
| 2003/0230405 | A1 | 12/2003 | Allamon et al. |
| 2005/0006106 | A1 | 1/2005 | Hirth et al. |
| 2007/0272413 | A1 | 11/2007 | Rytlewski et al. |
| 2009/0266544 | A1 | 10/2009 | Redlinger et al. |
| 2009/0272544 | A1* | 11/2009 | Giroux ..... E21B 47/122 166/382 |
| 2010/0051264 | A1 | 3/2010 | Willauer |
| 2010/0181079 | A1 | 7/2010 | Johnson et al. |
| 2011/0000663 | A1 | 1/2011 | Brandsdal |
| 2011/0240311 | A1 | 10/2011 | Robison et al. |
| 2012/0061100 | A1 | 3/2012 | Bræker |
| 2012/0067594 | A1 | 3/2012 | Noske et al. |
| 2013/0299196 | A1 | 11/2013 | Kolle |
| 2013/0327532 | A1 | 12/2013 | Ring et al. |
| 2014/0008083 | A1 | 1/2014 | Ring et al. |
| 2014/0116713 | A1 | 5/2014 | Broussard et al. |
| 2014/0138101 | A1 | 5/2014 | Arabsky et al. |
| 2014/0196912 | A1 | 7/2014 | Turley et al. |
| 2014/0262234 | A1 | 9/2014 | Walton et al. |
| 2014/0305662 | A1* | 10/2014 | Giroux ..... E21B 33/14 166/386 |
| 2015/0136393 | A1 | 5/2015 | Turley et al. |
| 2015/0136395 | A1 | 5/2015 | Turley et al. |
| 2015/0136396 | A1 | 5/2015 | Turley et al. |

OTHER PUBLICATIONS

Weatherford—Liner Hanger Selection brochure, May 2006, 24 pages.

Weatherford—HNG Hydraulic-Release Running Tool brochure, 2006, 1 page.

Weatherford—Weatherford's Linear Systems—Hang Tough brochure, 2008-2012, 16 pages.

Weatherford—SwageSet Series Liner-Top Packer brochure, 2011-2013, 6 pages.

Canadian Office Action dated Nov. 26, 2015, for Canadian Patent Application No. 2,869,260.

EPO Office Action dated Jan. 18, 2017, for European Patent Application No. 14191712.0.

Australian Patent Examination Report No. 1 dated Aug. 4, 2015, for Australian Application No. 2014259562.

* cited by examiner

RUNNING TOOL

BACKGROUND OF THE DISCLOSURE

Field of the Disclosure

The present disclosure generally relates to a telemetry operated running tool.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

A running tool is typically used to deploy a liner string into the wellbore. The running tool may also be used to deploy a casing string into a subsea wellbore. The running tool is used to releasably connect the liner string to a string of drill pipe for deployment into the wellbore. Once the liner string has been deployed to the desired depth and a hanger thereof set against a previously installed casing string, the running tool is then operated to release the liner string from the drill pipe string.

Running tools have typically been operated by over pull or pressure. There are a few running tools that are operated by left hand torque but this is an unfavorable design because when rotating to the left, any right hand threaded connections can be loosened unintentionally. Pressure operated running tools use a pump or dropped ball and seat; but, sometimes the ball doesn't land onto the seat or doesn't seal well enough to obtain the necessary pressure for operation of the running tool.

SUMMARY OF THE DISCLOSURE

The present disclosure generally relates to a telemetry operated running tool. In one embodiment, a running tool for deploying a tubular string into a wellbore includes a tubular body and a latch for releasably connecting the tubular string to the body. The latch includes a longitudinal fastener for engaging a longitudinal profile of the tubular string and a torsional fastener for engaging a torsional profile of the tubular string. The running tool further includes a lock movable between a locked position and an unlocked position and the lock keeps the latch engaged in the locked position. The running tool further includes an actuator operable to at least move the lock from the locked position to the unlocked position and an electronics package in communication with the actuator for operating the actuator in response to receiving a command signal.

In another embodiment, a method of hanging an inner tubular string from an outer tubular string cemented in a wellbore includes running the inner tubular string and a deployment assembly into the wellbore using a deployment string. A running tool of the deployment assembly longitudinally and torsionally fastens the liner string to the deployment string. The method further includes: plugging a bore of the deployment assembly; hanging the inner tubular string from the outer tubular string by pressurizing the plugged bore; and after hanging the inner tubular string, sending a command signal to the running tool, thereby unlocking or releasing the running tool.

In another embodiment, a running tool for deploying a tubular string into a wellbore includes a tubular body and a latch for releasably connecting the tubular string to the body. The latch includes a longitudinal fastener for engaging a longitudinal profile of the tubular string and a torsional fastener for engaging a torsional profile of the tubular string. The running tool further includes: a release operable to disengage the longitudinal fastener from the longitudinal profile of the tubular string; an actuator operable to engage the release with the longitudinal fastener; and an electronics package in communication with the actuator for operating the actuator in response to receiving a command signal.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
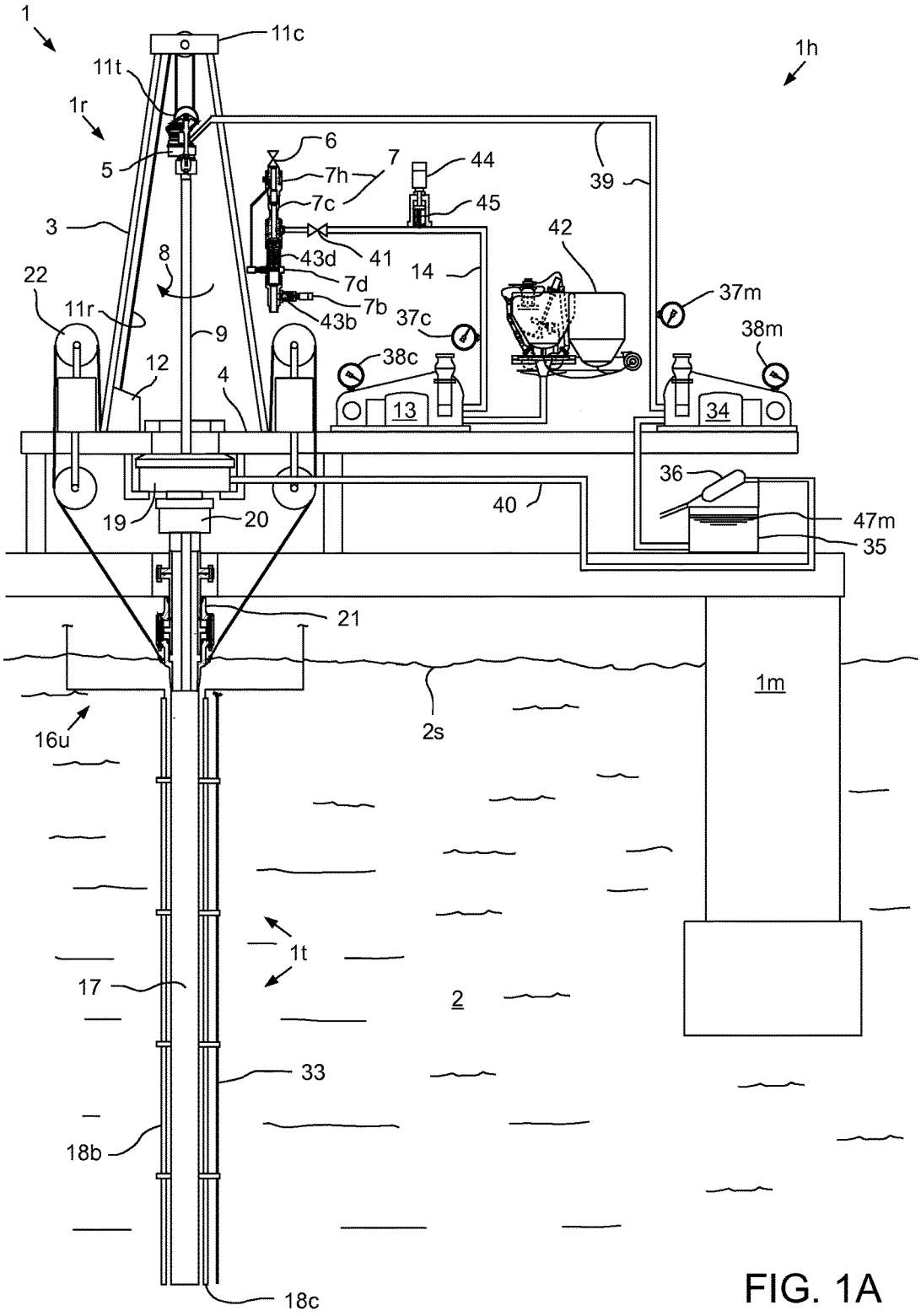
FIGS. 1A-1C illustrate a drilling system in a liner deployment mode, according to one embodiment of this disclosure.
Figure 1B:
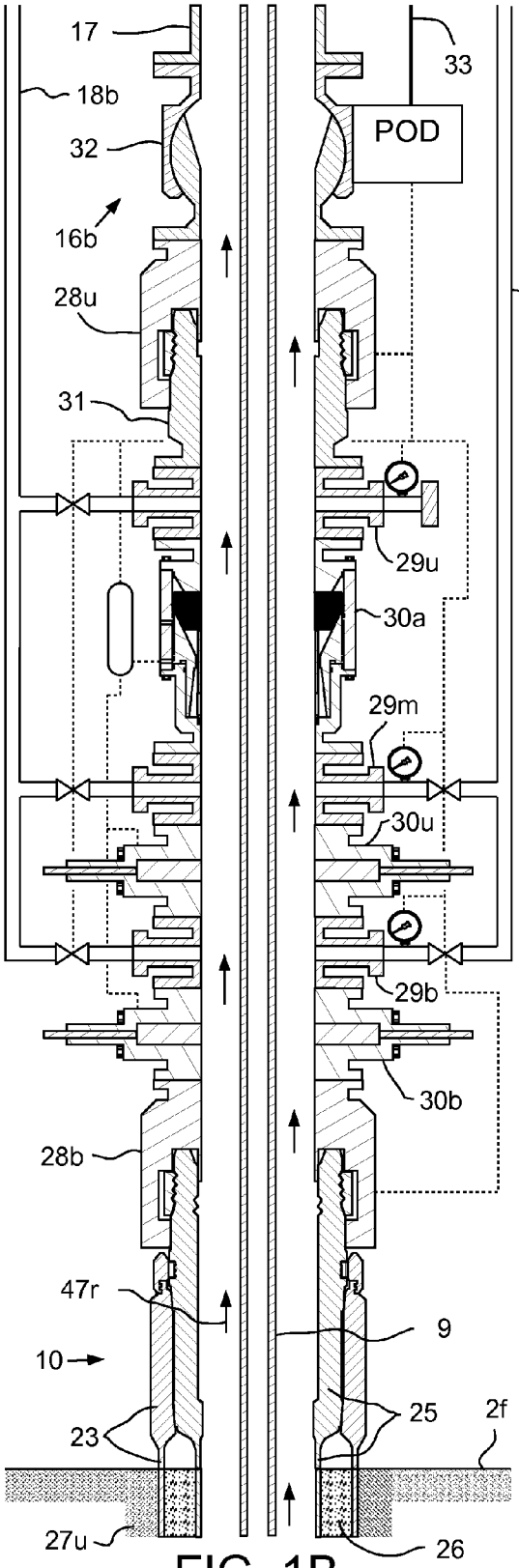
Figure 1C:
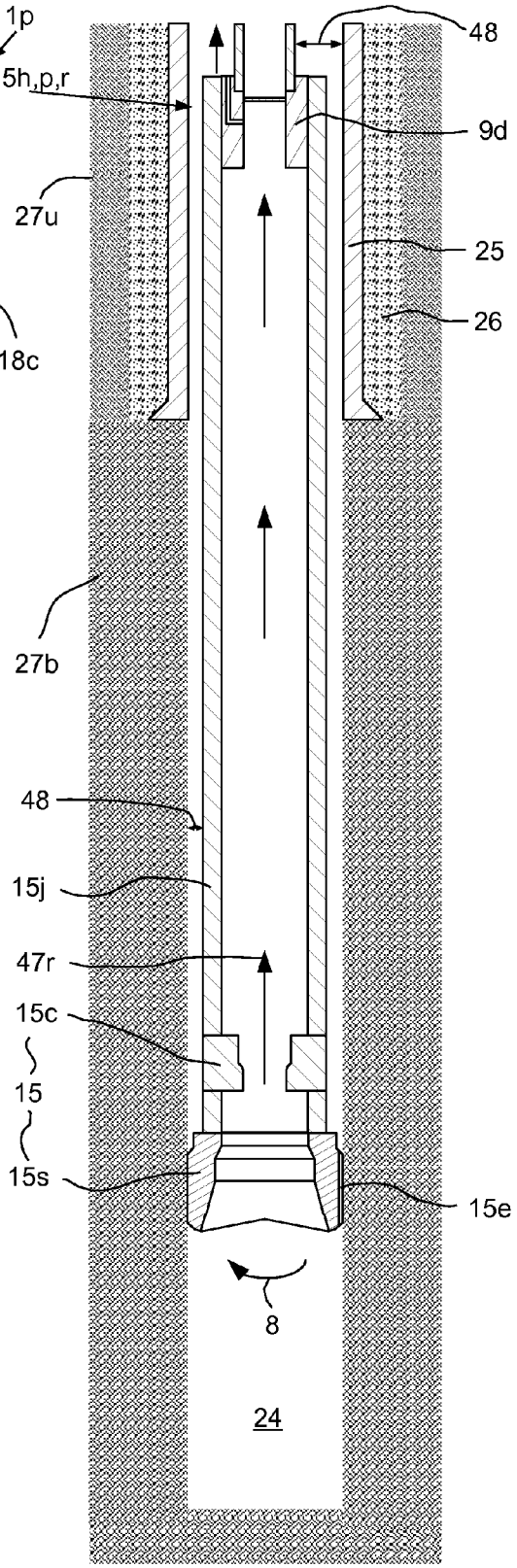

FIGS. 1A-1C illustrate a drilling system in a liner deployment mode, according to one embodiment of this disclosure. The drilling system 1 may include a mobile offshore drilling unit (MODU) 1*m*, such as a semi-submersible, a drilling rig

1*r*, a fluid handling system 1*h*, a fluid transport system 1*t*, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, a cementing head 7, and a hoist. The top drive 5 may include a motor for rotating 8 the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The frame of the top drive 5 may be suspended from the derrick 3 by the traveling block 11*t*. The quill may be torsionally driven by the top drive motor and supported from the frame by bearings. The top drive may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

Alternatively, a Kelly and rotary table may be used instead of the top drive.

Figures 2A, 2B, 2C, 2D:
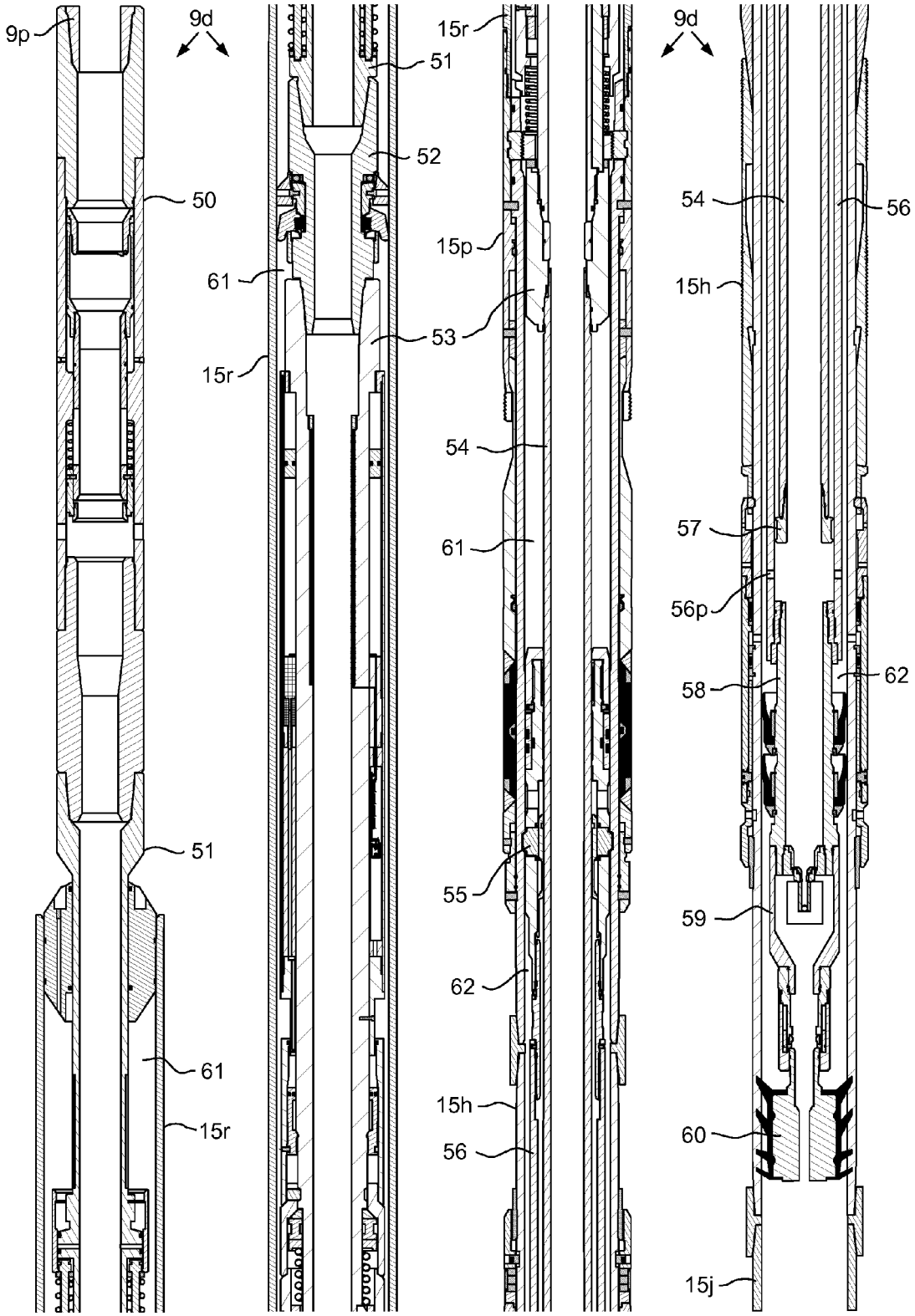
FIGS. 2A-2D illustrate a liner deployment assembly (LDA) of the drilling system.

In the deployment mode, an upper end of the workstring 9 may be connected to the top drive quill, such as by threaded couplings. The workstring 9 may include a liner deployment assembly (LDA) 9*d* and a deployment string, such as joints of drill pipe 9*p* (FIG. 2A) connected together, such as by threaded couplings. An upper end of the LDA 9*d* may be connected a lower end of the drill pipe 9*p*, such as by threaded couplings. The LDA 9*d* may also be connected to a liner string 15. The liner string 15 may include a polished bore receptacle (PBR) 15*r*, a packer 15*p*, a liner hanger 15*h*, joints of liner 15*j*, a landing collar 15*c*, and a reamer shoe 15*s*. The liner string members may each be connected together, such as by threaded couplings. The reamer shoe 15*s* may be rotated 8 by the top drive 5 via the workstring 9.

Alternatively, drilling fluid may be injected into the liner string during deployment thereof. Alternatively, drilling fluid may be injected into the liner string and the liner string 15 may include a drillable drill bit (not shown) instead of the reamer shoe 15*s* and the liner string may be drilled into the lower formation 27*b*, thereby extending the wellbore 24 while deploying the liner string.

Once liner deployment has concluded, the workstring 9 may be disconnected from the top drive and the cementing head 7 may be inserted and connected therebetween. The cementing head 7 may include an isolation valve 6, an actuator swivel 7*h*, a cementing swivel 7*c*, and one or more plug launchers, such as a dart launcher 7*d* and a ball launcher 7*b*. The isolation valve 6 may be connected to a quill of the top drive 5 and an upper end of the actuator swivel 7*h*, such as by threaded couplings. An upper end of the workstring 9 may be connected to a lower end of the cementing head 7, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation 8 of the mandrel. An upper end of the mandrel may be connected to a lower end of the actuator swivel, such as by threaded couplings. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. The seal assembly may include one or more stacks of V-shaped seal rings, such as opposing stacks, disposed between the mandrel and the housing and straddling the inlet-port interface. The actuator swivel 7*h* may be similar to the cementing swivel 7*c* except that the housing may have two inlets in fluid communication with respective passages formed through the mandrel. The mandrel passages may extend to respective outlets of the mandrel for connection to respective hydraulic conduits (only one shown) for operating respective hydraulic actuators of the launchers 7*b,d*. The actuator swivel inlets may be in fluid communication with a hydraulic power unit (HPU, not shown).

Alternatively, the seal assembly may include rotary seals, such as mechanical face seals.

The dart launcher 7*d* may include a body, a diverter, a canister, a latch, and the actuator. The body may be tubular and may have a bore therethrough. To facilitate assembly, the body may include two or more sections connected together, such as by threaded couplings. An upper end of the body may be connected to a lower end of the actuator swivel, such as by threaded couplings and a lower end of the body may be connected to the workstring 9. The body may further have a landing shoulder formed in an inner surface thereof. The canister and diverter may each be disposed in the body bore. The diverter may be connected to the body, such as by threaded couplings. The canister may be longitudinally movable relative to the body. The canister may be tubular and have ribs formed along and around an outer surface thereof. Bypass passages may be formed between the ribs. The canister may further have a landing shoulder formed in a lower end thereof corresponding to the body landing shoulder. The diverter may be operable to deflect fluid received from a cement line 14 away from a bore of the canister and toward the bypass passages. A release plug, such as dart 43*d*, may be disposed in the canister bore.

The latch may include a body, a plunger, and a shaft. The latch body may be connected to a lug formed in an outer surface of the launcher body, such as by threaded couplings.

The plunger may be longitudinally movable relative to the latch body and radially movable relative to the launcher body between a capture position and a release position. The plunger may be moved between the positions by interaction, such as a jackscrew, with the shaft. The shaft may be longitudinally connected to and rotatable relative to the latch body. The actuator may be a hydraulic motor operable to rotate the shaft relative to the latch body.

The ball launcher 7*b* may include a body, a plunger, an actuator, and a setting plug, such as a ball 43*b*, loaded therein. The ball launcher body may be connected to another lug formed in an outer surface of the dart launcher body, such as by threaded couplings. The ball 43*b* may be disposed in the plunger for selective release and pumping downhole through the drill pipe 9*p* to the LDA 9*d*. The plunger may be movable relative to the respective dart launcher body between a captured position and a release position. The plunger may be moved between the positions by the actuator. The actuator may be hydraulic, such as a piston and cylinder assembly.

Alternatively, the actuator swivel and launcher actuators may be pneumatic or electric. Alternatively, the launcher actuators may be linear, such as piston and cylinders.

In operation, when it is desired to launch one of the plugs 43*b,d*, the HPU may be operated to supply hydraulic fluid to the appropriate launcher actuator via the actuator swivel 7*h*. The selected launcher actuator may then move the plunger to the release position (not shown). If the dart launcher 7*d* is selected, the canister and dart 43*d* may then move downward relative to the housing until the landing shoulders engage. Engagement of the landing shoulders may close the canister bypass passages, thereby forcing fluid to flow into the canister bore. The fluid may then propel the dart 43*d* from the canister bore into a lower bore of the housing and onward through the workstring 9. If the ball launcher 7*b* was selected, the plunger may carry the ball 43*b* into the launcher housing to be propelled into the drill pipe 9*p* by the fluid.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 21, such as by a flanged connection. The diverter 21 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump (not shown). A lower end of the choke line 18*c* may have prongs connected to respective second branches of the flow crosses 29*m,b*. Shutoff valves may be disposed in respective prongs of the choke line lower end.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33 may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extended between the MODU and the PCA independently of the riser. Alternatively, the shutoff valve actuators may be electrical or pneumatic.

The fluid handling system 1*h* may include one or more pumps, such as a cement pump 13 and a mud pump 34, a reservoir for drilling fluid 47*m*, such as a tank 35, a solids separator, such as a shale shaker 36, one or more pressure gauges 37*c,m*, one or more stroke counters 38*c,m*, one or more flow lines, such as cement line 14, mud line 39, and return line 40, a cement mixer 42, and a tag launcher 44. The drilling fluid 47*m* may include a base liquid. The base liquid may be refined or synthetic oil, water, brine, or a water/oil emulsion. The drilling fluid 47*m* may further include solids dissolved or suspended in the base liquid, such as organophilic clay, lignite, and/or asphalt, thereby forming a mud.

A first end of the return line 40 may be connected to the diverter outlet and a second end of the return line may be connected to an inlet of the shaker 36. A lower end of the mud line 39 may be connected to an outlet of the mud pump 34 and an upper end of the mud line may be connected to the top drive inlet. The pressure gauge 37*m* may be assembled as part of the mud line 39. An upper end of the cement line 14 may be connected to the cementing swivel inlet and a lower end of the cement line may be connected to an outlet of the cement pump 13. The tag launcher 44, a shutoff valve 41, and the pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The tag launcher 44 may include a housing, a plunger, an actuator, and a magazine (not shown) having a plurality of wireless identification tags, such as radio frequency identification (RFID) tags loaded therein. A chambered RFID tag 45 may be disposed in the respective plunger for selective release and pumping downhole to communicate with the LDA 9*d*. The plunger may be movable relative to the launcher housing between a captured position and a release position. The plunger may be moved between the positions by the actuator. The actuator may be hydraulic, such as a piston and cylinder assembly.

Alternatively, the actuator may be electric or pneumatic. Alternatively, the actuator may be manual, such as a handwheel. Alternatively, the tag 45 may be manually launched by breaking a connection in the respective line. Alternatively, the plug launcher may be part of the cementing head.

The workstring 9 may be rotated 8 by the top drive 5 and lowered by the traveling block 11*t*, thereby reaming the liner string 15 into the lower formation 27*b*. Drilling fluid in the wellbore 24 may be displaced through courses 15*e* of the reamer shoe 15*s*, where the fluid may circulate cuttings away from the shoe and return the cuttings into a bore of the liner string 15. The returns 47*r* (drilling fluid plus cuttings) may flow up the liner bore and into a bore of the LDA 9*d*. The returns 47*r* may flow up the LDA bore and to a diverter valve 50 (FIG. 2A) thereof. The returns 47*r* may be diverted into an annulus 48 formed between the workstring 9/liner string 15 and the casing string 25/wellbore 24 by the diverter valve 50. The returns 47*r* may exit the wellbore 24 and flow into an annulus formed between the riser 17 and the drill pipe 9*p* via an annulus of the LMRP 16*b*, BOP stack, and wellhead 10. The returns may exit the riser annulus and enter the return line 40 via an annulus of the UMRP 16*u* and the diverter 19. The returns 47*r* may flow through the return line 40 and into the shale shaker inlet. The returns 47*r* may be processed by the shale shaker 36 to remove the cuttings.

FIGS. 2A-2D illustrate the liner deployment assembly LDA 9*d*. The LDA 9*d* may include a diverter valve 50, a junk bonnet 51, a setting tool 52, a running tool 53, a stinger 54, an upper packoff 55, a spacer 56, a release 57, a lower packoff 58, a catcher 59, and a plug release system 60.

An upper end of the diverter valve 50 may be connected to a lower end the drill pipe 9*p* and a lower end of the diverter valve 50 may be connected to an upper end of the junk bonnet 51, such as by threaded couplings. A lower end of the junk bonnet 51 may be connected to an upper end of the setting tool 52 and a lower end of the setting tool may be connected to an upper end of the running tool 53, such as by threaded couplings. The running tool 53 may also be fastened to the packer 15*p*. An upper end of the stinger 54 may be connected to a lower end of the running tool 53 and a lower end of the stringer may be connected to the release 57, such as by threaded couplings. The stinger 54 may extend through the upper packoff 55. The upper packoff 55 may be fastened to the packer 15*p*. An upper end of the spacer 56 may be connected to a lower end of the upper packoff 55, such as by threaded couplings. An upper end of the lower packoff 58 may be connected to a lower end of the spacer 56, such as by threaded couplings. An upper end of the catcher 59 may be connected to a lower end of the lower packoff 58, such as by threaded couplings. An upper end of the plug release system 60 may be connected to a lower end of the catcher 59 such as by threaded couplings.

The diverter valve 50 may include a housing, a bore valve, and a port valve. The diverter housing may include two or more tubular sections (three shown) connected to each other, such as by threaded couplings. The diverter housing may have threaded couplings formed at each longitudinal end thereof for connection to the drill pipe 9*p* at an upper end thereof and the junk bonnet 51 at a lower end thereof. The bore valve may be disposed in the housing. The bore valve may include a body and a valve member, such as a flapper, pivotally connected to the body and biased toward a closed position, such as by a torsion spring. The flapper may be oriented to allow downward fluid flow from the drill pipe 9*p* through the rest of the LDA 9*d* and prevent reverse upward flow from the LDA to the drill pipe 9*p*. Closure of the flapper may isolate an upper portion of a bore of the diverter valve from a lower portion thereof. Although not shown, the body may have a fill orifice formed through a wall thereof and bypassing the flapper.

The diverter port valve may include a sleeve and a biasing member, such as a compression spring. The sleeve may include two or more sections (four shown) connected to each other, such as by threaded couplings and/or fasteners. An upper section of the sleeve may be connected to a lower end of the bore valve body, such as by threaded couplings.

Figures 4A, 4B, 4C:
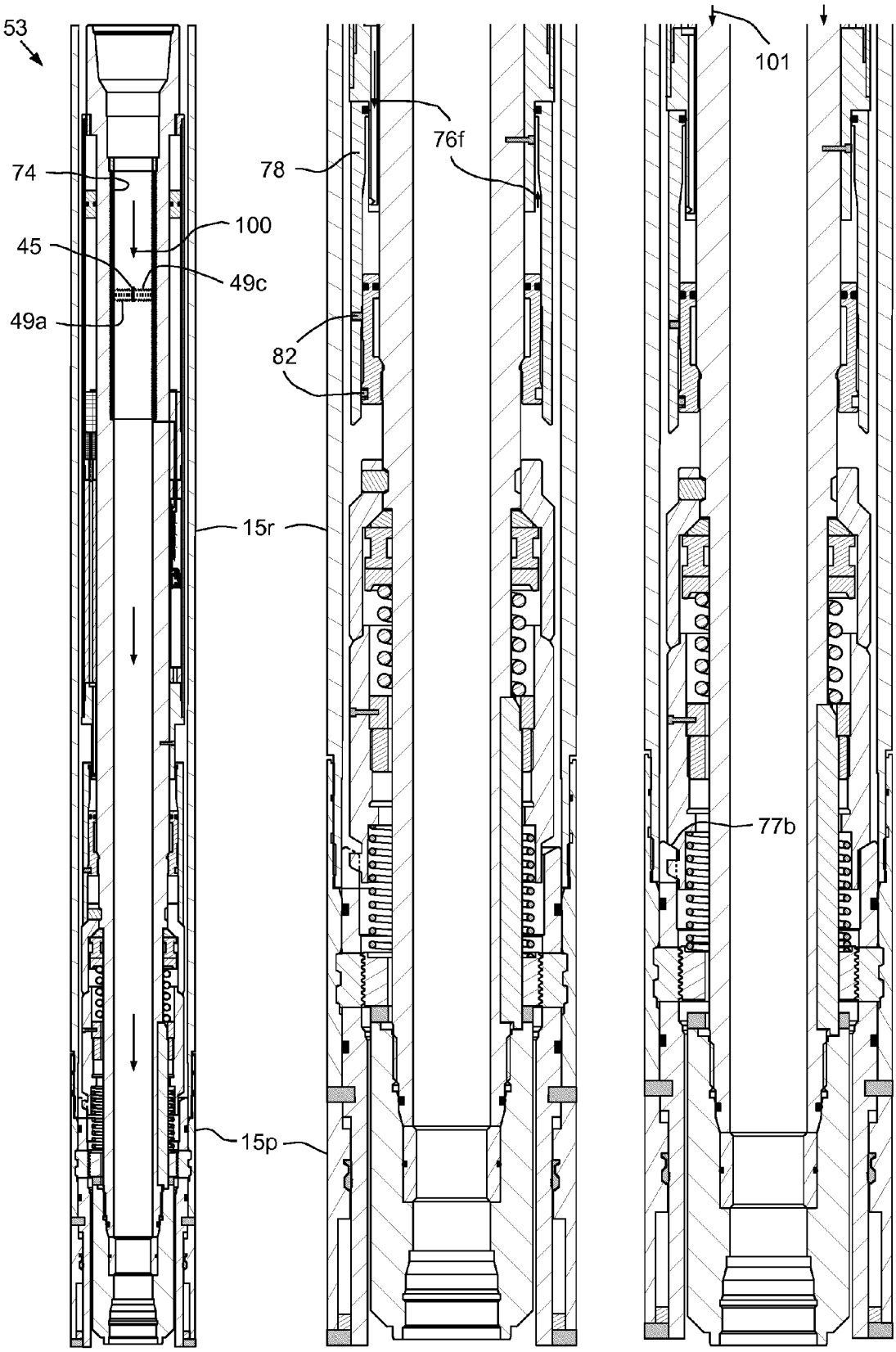
FIGS. 4A-4F illustrate operation of the running tool.

Various interfaces between the sleeve and the housing and between the housing sections may be isolated by seals. The sleeve may be disposed in the housing and longitudinally movable relative thereto between an upper position (shown) and a lower position (FIG. 4A). The sleeve may be stopped in the lower position against an upper end of the lower housing section and in the upper position by the bore valve body engaging a lower end of the upper housing section. The mid housing section may have one or more flow ports and one or more equalization ports formed through a wall thereof. One of the sleeve sections may have one or more equalization slots formed therethrough providing fluid communication between a spring chamber formed in an inner surface of the mid housing section and the lower bore portion of the diverter valve 50.

One of the sleeve sections may cover the housing flow ports when the sleeve is in the lower position, thereby closing the housing flow ports and the sleeve section may be clear of the flow ports when the sleeve is in the upper position, thereby opening the flow ports. In operation, surge pressure of the returns 47*r* generated by deployment of the LDA 9*d* and liner string 15 into the wellbore may be exerted on a lower face of the closed flapper. The surge pressure may push the flapper upward, thereby also pulling the sleeve upward against the compression spring and opening the housing flow ports. The surging returns 47*r* may then be diverted through the open flow ports by the closed flapper. Once the liner string 15 has been deployed, dissipation of the surge pressure may allow the spring to return the sleeve to the lower position.

The junk bonnet 51 may include a piston, a mandrel, and a release valve. Although shown as one piece, the mandrel may include two or more sections connected to each other, such as by threaded couplings and/or fasteners. The mandrel may have threaded couplings formed at each longitudinal end thereof for connection to the diverter valve 50 at an upper end thereof and the setting tool 52 at a lower end thereof.

The junk piston may be an annular member having a bore formed therethrough. The mandrel may extend through the piston bore and the piston may be longitudinally movable relative thereto subject to entrapment between an upper shoulder of the mandrel and the release valve. The piston may carry one or more (two shown) outer seals and one or more (two shown) inner seals. Although not shown, the junk bonnet 51 may further include a split seal gland carrying each piston inner seal and a retainer for connecting the each seal gland to the piston, such as by a threaded connection. The inner seals may isolate an interface between the piston and the mandrel.

The junk piston may also be disposed in a bore of the PBR 15*r* adjacent an upper end thereof and be longitudinally movable relative thereto. The outer seals may isolate an interface between the piston and the PBR 15*r*, thereby forming an upper end of a buffer chamber 61. A lower end of the buffer chamber 61 may be formed by a sealed interface between the upper packoff 55 and the packer 15*p*. The buffer chamber 61 may be filled with a hydraulic fluid (not shown), such as fresh water or oil, such that the piston may be hydraulically locked in place. The buffer chamber 61 may prevent infiltration of debris from the wellbore 24 from obstructing operation of the LDA 9*d*. The junk piston may include a fill passage extending longitudinally therethrough closed by a plug. The mandrel may include a bypass groove formed in and along an outer surface thereof. The bypass groove may create a leak path through the piston inner seals during removal of the LDA 9*d* from the liner string 15 to release the hydraulic lock.

The release valve may include a shoulder formed in an outer surface of the mandrel, a closure member, such as a sleeve, and one or more biasing members, such as compression springs. Each spring may be carried on a rod and trapped between a stationary washer connected to the rod and a washer slidable along the rod. Each rod may be disposed in a pocket formed in an outer surface of the mandrel. The sleeve may have an inner lip trapped formed at a lower end thereof and extending into the pockets. The lower end may also be disposed against the slidable washer. The valve shoulder may have one or more one or more radial ports formed therethrough. The valve shoulder may carry a pair of seals straddling the radial ports and engaged with the valve sleeve, thereby isolating the mandrel bore from the buffer chamber 61.

The junk piston may have a torsion profile formed in a lower end thereof and the valve shoulder may have a complementary torsion profile formed in an upper end thereof. The piston may further have reamer blades formed in an upper surface thereof. The torsion profiles may mate during removal of the LDA 9*d* from the liner string 15, thereby torsionally connecting the junk piston to the mandrel. The junk piston may then be rotated during removal to back ream debris accumulated adjacent an upper end of the PBR 15*r*. The junk piston lower end may also seat on the valve sleeve during removal. Should the bypass groove be clogged, pulling of the drill pipe 9*p* may cause the valve sleeve to be pushed downward relative to the mandrel and against the springs to open the radial ports, thereby releasing the hydraulic lock.

Alternatively, the junk piston may include two elongate hemi-annular segments connected together by fasteners and having gaskets clamped between mating faces of the segments to inhibit end-to-end fluid leakage. Alternatively, the junk piston may have a radial bypass port formed therethrough at a location between the upper and lower inner seals and the bypass groove may create the leak path through the lower inner seal to the bypass port. Alternatively, the valve sleeve may be fastened to the mandrel by one or more shearable fasteners.

The setting tool 52 may include a body, a plurality of fasteners, such as dogs, and a rotor. Although shown as one piece, the body may include two or more sections connected to each other, such as by threaded couplings and/or fasteners. The body may have threaded couplings formed at each longitudinal end thereof for connection to the junk bonnet 51 at an upper end thereof and the running tool 53 at a lower end thereof. The body may have a recess formed in an outer surface thereof for receiving the rotor. The rotor may include a thrust ring, a thrust bearing, and a guide ring. The guide ring and thrust bearing may be disposed in the recess. The thrust bearing may have an inner race torsionally connected to the body, such as by press fit, an outer race torsionally connected to the thrust ring, such as by press fit, and a rolling element disposed between the races. The thrust ring may be connected to the guide ring, such as by one or more threaded fasteners. An upper portion of a pocket may be formed between the thrust ring and the guide ring. The setting tool 52 may further include a retainer ring connected to the body adjacent to the recess, such as by one or more threaded fasteners. A lower portion of the pocket may be formed between the body and the retainer ring. The dogs may be disposed in the pocket and spaced around the pocket.

Each dog may be movable relative to the rotor and the body between a retracted position (shown) and an extended position. Each dog may be urged toward the extended position by a biasing member, such as a compression spring. Each dog may have an upper lip, a lower lip, and an opening. An inner end of each spring may be disposed against an outer surface of the guide ring and an outer portion of each spring may be received in the respective dog opening. The upper lip of each dog may be trapped between the thrust ring and the guide ring and the lower lip of each dog may be trapped between the retainer ring and the body. Each dog may also be trapped between a lower end of the thrust ring and an upper end of the retainer ring. Each dog may also be torsionally connected to the rotor, such as by a pivot fastener (not shown) received by the respective dog and the guide ring.

An upper end of an actuation chamber 62 may be formed by the sealed interface between the upper packoff 55 and the packer 15*p*. A lower end of the actuation chamber 62 may be formed by the sealed interface between the lower packoff 58 and the liner hanger 15*h*. The actuation chamber 62 may be in fluid communication with the LDA bore (above a ball seat of the catcher 59) via one or more ports 56*p* formed through a wall of the spacer 56.

Alternatively, the plug release system 60 may include a seat for receiving the ball 43*b* and a cementing plug thereof may serve as the lower packoff, thereby obviating the need for the catcher 59 and the lower packoff 58.

Figure 3A:
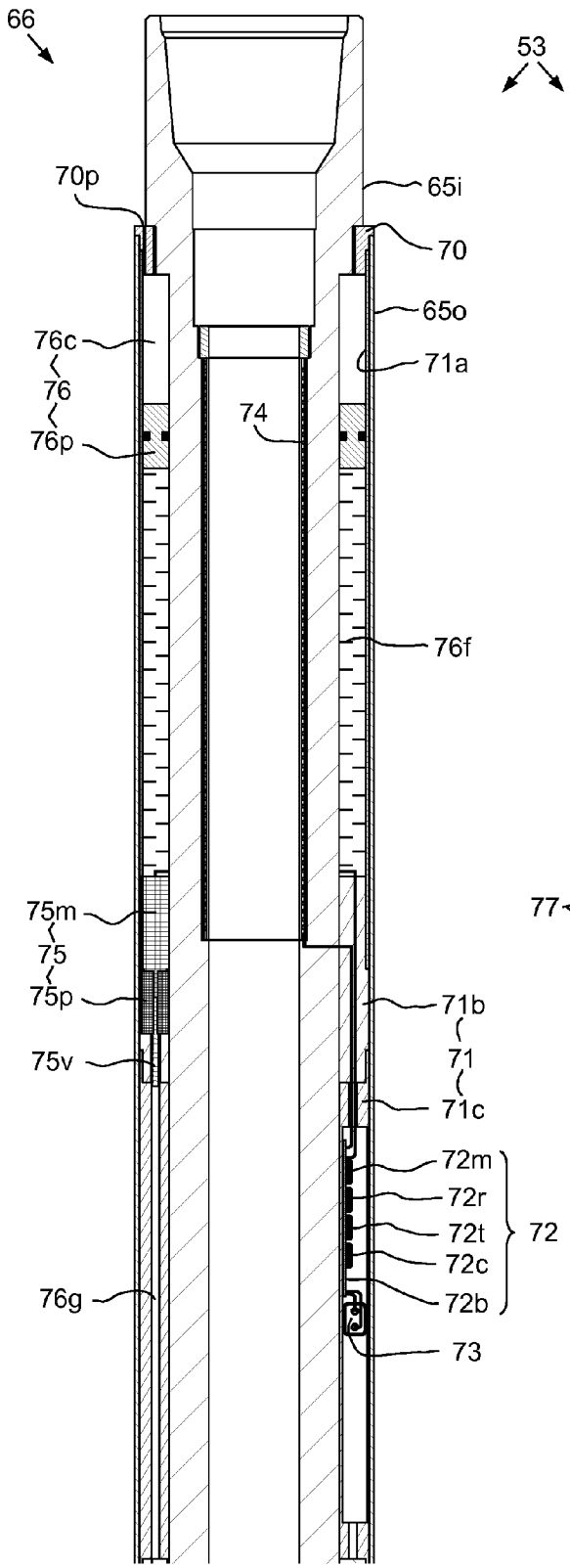
FIGS. 3A and 3B illustrate a running tool of the LDA.
Figure 3B:
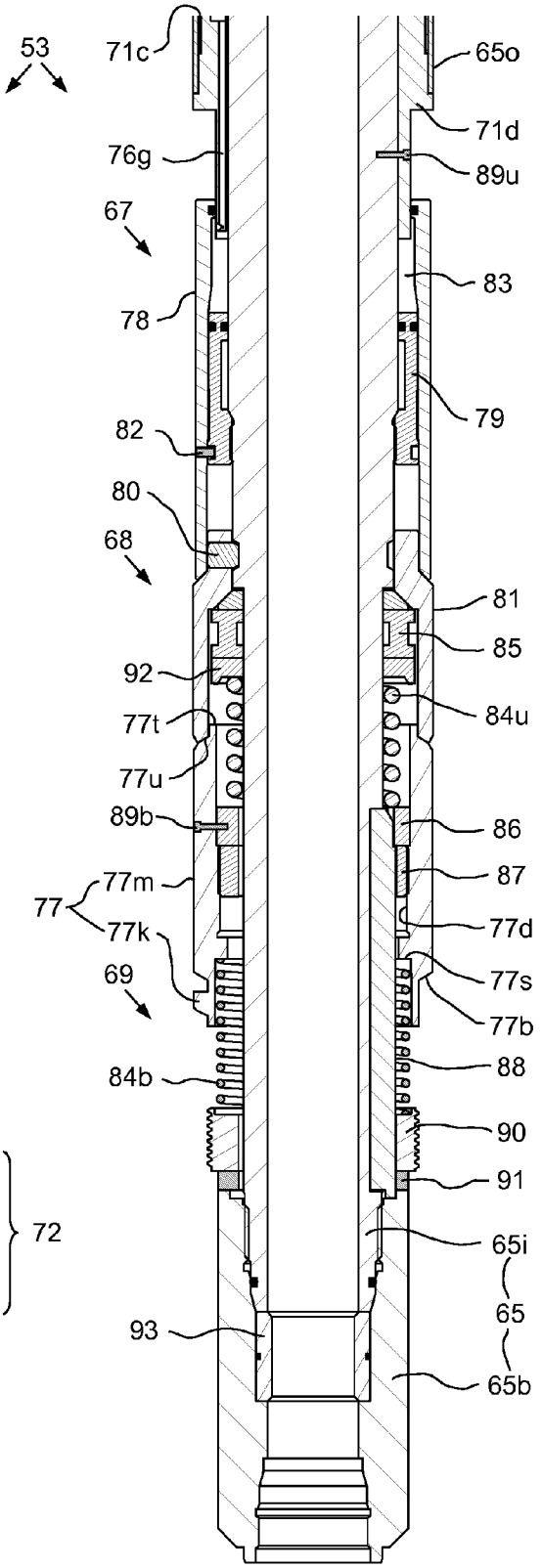

FIGS. 3A and 3B illustrate the running tool 53. The running tool 53 may include a body 65, a controller 66, a lock 67, a clutch 68, and a latch 69. The body 65 may have a bore formed therethrough and include two or more tubular sections 65*i,o,b*. An inner body section 65*i* may be connected to a lower body section 65*b*, such as by threaded couplings. A spacer 93 may be disposed between a lower end of the inner body section 65*i* and a shoulder formed in an inner surface of the lower body section 65*b*. A fastener, such as a threaded nut 70, may be connected to a threaded coupling formed in an outer surface of the inner body section 65*i* and may receive an upper end of the outer housing section 65*o*. The body 65 may also have threaded couplings formed at each longitudinal end thereof for connection to the setting tool 52 at an upper end thereof and the stinger 54 at a lower end thereof.

The controller 66 may include a housing 71, an electronics package 72, a power source, such as a battery 73, an antenna 74, an actuator 75, and hydraulics 76. The housing 71 may have a bore formed therethrough and include two or more tubular sections 71*a-d*. A lower housing section 71*d* may be connected to the inner body section 65*i*, such as by a threaded fastener 89*u*. The lower housing section 71*d* may receive a lower end of the outer body section 65*o*, thereby connecting the outer body section to the inner body section 65*i*. The nut 70 may also receive an upper end of an upper housing section 71*a* and a second housing section 71*b* may receive a lower end of the upper housing section. The second housing section 71*b* may also receive an upper end of a third housing section 71*c*. The lower housing section 71*d* may receive a lower end of the third housing section 71*c*, thereby connecting the housing 71 to the inner body section 65*i*.

Alternatively, the power source may be a capacitor or inductor instead of the battery 73.

The hydraulics 76 may include a reservoir chamber 76*c*, a balance piston 76*p*, hydraulic fluid, such as oil 76*f*, and a hydraulic passage 76*g*. The balance piston 76*p* may be disposed in the reservoir chamber 76*c* formed between the upper housing section 71*a* and the inner body section 65*i* and may divide the chamber into an upper portion and a lower portion. A port 70*p* may be formed through a wall of the nut 70 and may provide fluid communication between the reservoir chamber upper portion and the buffer chamber 61. The hydraulic oil 76*f* may be disposed in the reservoir chamber lower portion. The balance piston 76*p* may carry inner and outer seals for isolating the hydraulic oil 76*f* from the reservoir chamber upper portion.

The second housing section 71*b* may have an electrical conduit formed through a wall thereof for receiving lead wires connecting the antenna 74 to the electronics package 72 and connecting the actuator 75 to the electronics package. The second housing section 71*b* may also have a cavity formed in an upper end thereof for receiving the actuator 75. The actuator 75 may be connected to the housing 71, such as by interference fit or fastening. The hydraulic passage 76*g* may provide fluid communication between the actuator 75 and the lock 67. An upper portion of the hydraulic passage 76*g* may be formed through a wall of the third housing section 71*c* and a lower portion of the hydraulic passage may be formed through a wall of the lower housing section 71*d*.

The antenna 74 may be tubular and extend along an inner surface of the inner housing section 65*i*. The antenna 74 may include an inner liner, a coil, and a jacket. The antenna liner may be made from a non-magnetic and non-conductive material, such as a polymer or composite, have a bore formed longitudinally therethrough, and have a helical groove formed in an outer surface thereof. The antenna coil may be wound in the helical groove and made from an electrically conductive material, such as copper or alloy thereof. The antenna jacket may be made from the non-magnetic and non-conductive material and may insulate the coil. The antenna lead wires may be connected to ends of the antenna coil. The antenna liner may have a flange formed at an upper end thereof. The antenna may be received in a recess formed in an inner surface of the inner body section 65*i*. The flange may be threaded and engaged with a threaded shoulder formed in an inner surface of the inner body section 65*i*, thereby connecting the antenna 74 to the body 61.

The third housing section 71*c* may have one or more (only one shown) pockets formed in an outer surface thereof. Although shown in the same pocket, the electronics package 72 and battery 73 may be disposed in respective pockets of the third housing section 71*c*. The electronics package 72 may include a control circuit 72*c*, a transmitter 72*t*, a receiver 72*r*, and a motor controller 72*m* integrated on a printed circuit board 72*b*. The control circuit 72*c* may include a microcontroller (MCU), a memory unit (MEM), a clock, and an analog-digital converter. The transmitter 72*t* may include an amplifier (AMP), a modulator (MOD), and an oscillator (OSC). The receiver 72*r* may include an amplifier (AMP), a demodulator (MOD), and a filter (FIL). The motor controller 72*m* may include a power converter for converting a DC power signal supplied by the battery 73 into a suitable power signal for driving an electric motor 75*m* of the actuator 75. The electronics package 72 may be housed in an encapsulation.

Figure 1D:
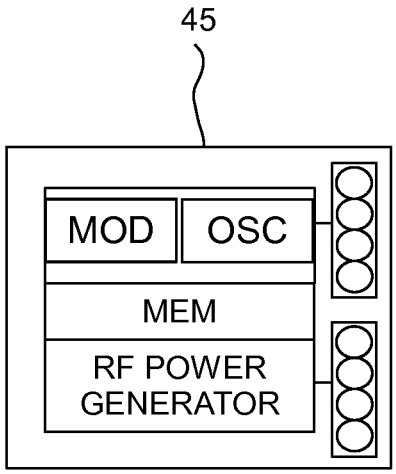
FIG. 1D illustrates a radio frequency identification (RFID) tag of the drilling system.

FIG. 1D illustrates the RFID tag 45. The RFID tag 45 may be a passive tag and include an electronics package and one or more antennas housed in an encapsulation. The electronics package may include a memory unit, a transmitter, and a radio frequency (RF) power generator for operating the transmitter. The RFID tag 45 may be programmed with a command signal addressed to the running tool 53. The RFID tag 45 may be operable to transmit a wireless command signal 49*c* (FIG. 4A), such as a digital electromagnetic command signal, to the antenna 74 in response to receiving an activation signal 49*a* therefrom. The MCU of the control circuit 72*c* may receive the command signal 49*c* and operate the actuator 75 in response to receiving the command signal.

Figure 1E:
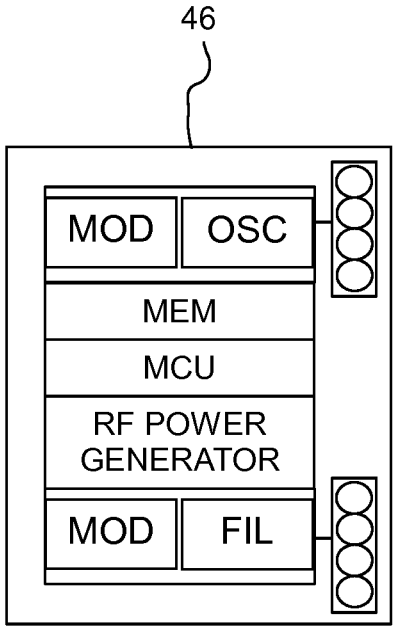
FIG. 1E illustrates an alternative RFID tag.

FIG. 1E illustrates an alternative RFID tag 46. Alternatively, the RFID tag 45 may instead be a wireless identification and sensing platform (WISP) RFID tag 46. The WISP tag 46 may further a microcontroller (MCU) and a receiver for receiving, processing, and storing data from the running tool 53. Alternatively, the RFID tag may be an active tag having an onboard battery powering a transmitter instead of having the RF power generator or the WISP tag may have an onboard battery for assisting in data handling functions. The active tag may further include a safety, such as pressure switch, such that the tag does not begin to transmit until the tag is in the wellbore.

Returning to FIGS. 3A and 3B, the actuator 75 may include the electric motor 75*m*, a pump 75*p*, a control valve, such as spool valve 75*v*, and a pressure sensor (not shown). The electric motor 75*m* may include a stator in electrical communication with the motor controller 72*m* and a head in electromagnetic communication with the stator for being driven thereby. The motor head may be longitudinally or torsionally driven. The pump 63*p* may have a stator connected to the motor stator and a cylinder connected to the motor head (directly or via lead screw) for being reciprocated thereby. The pump 75*p* may have an inlet in fluid communication with the lower reservoir chamber portion and an outlet in fluid communication with the hydraulic passage 76*g*. The spool valve 75*v* may selectively provide fluid communication between the pump piston and the inlet or outlet depending on the stroke. The spool valve 75*v* may be mechanically, electrically, or hydraulically operated. The pressure sensor may be in fluid communication with the pump outlet and the MCU may be in electrical communication with the pressure sensor to determine when the lock 67 has been released by detecting a corresponding pressure increase at the outlet of the pump 75*p*.

The latch 69 may longitudinally and torsionally connect the liner string 15 to an upper portion of the LDA 9*d*. The latch 69 may include a thrust cap 77, a longitudinal fastener, such as a floating nut 90, and a biasing member, such as a lower compression spring 84*b*. The thrust cap 77 may have an upper shoulder 77*u* formed in an outer surface thereof and adjacent to an upper end 77*t* thereof, an enlarged mid portion 77*m*, a lower shoulder 77*b* formed in an outer surface thereof, a torsional fastener, such as a key 77*k*, formed in an outer surface thereof, a lead screw 77*d* formed in an inner surface thereof, and a spring shoulder 77*s* formed in an inner surface thereof. The key 77*k* may mate with a torsional profile, such as a castellation, formed in an upper end of the packer 15*p* and the floating nut 90 may be screwed into threaded dogs of the packer. The lock 67 may be disposed on the inner body section 65*i* to prevent premature release of the latch 69 from the liner string 15. The clutch 68 may selectively torsionally connect the thrust cap 77 to the body 65.

The lock 67 may include a piston 78, a plug 79, a fastener, such as a dog 80, and a sleeve 81. The plug 79 may be connected to an outer surface of the inner body section 65*i*, such as by threaded couplings. The plug 79 may carry an inner seal and an outer seal. The inner seal may isolate an interface formed between the plug and the body 65 and the outer seal may isolate an interface formed between the plug and the piston 78. The piston 78 may be longitudinally movable relative to the body 65 between an upper position (FIG. 4B) and a lower position (shown). The piston 78 may initially be fastened to the plug 79, such as by a shearable fastener 82. In the lower position, the piston 78 may have an upper portion disposed along an outer surface of the lower housing section 71*d*, a mid portion disposed along an outer surface of the plug 79, and a lower portion received by the lock sleeve 81, thereby locking the dog 80 in a retracted position. The piston 78 may carry an inner seal in the upper portion for isolating an interface formed between the body 65 and the piston. An actuation chamber 83 may be formed between the piston 78, plug 79, and the inner body section 65*i*. A lower end of the hydraulic passage 76*g* may be in fluid communication with the actuation chamber 83.

Figures 4D, 4E, 4F:
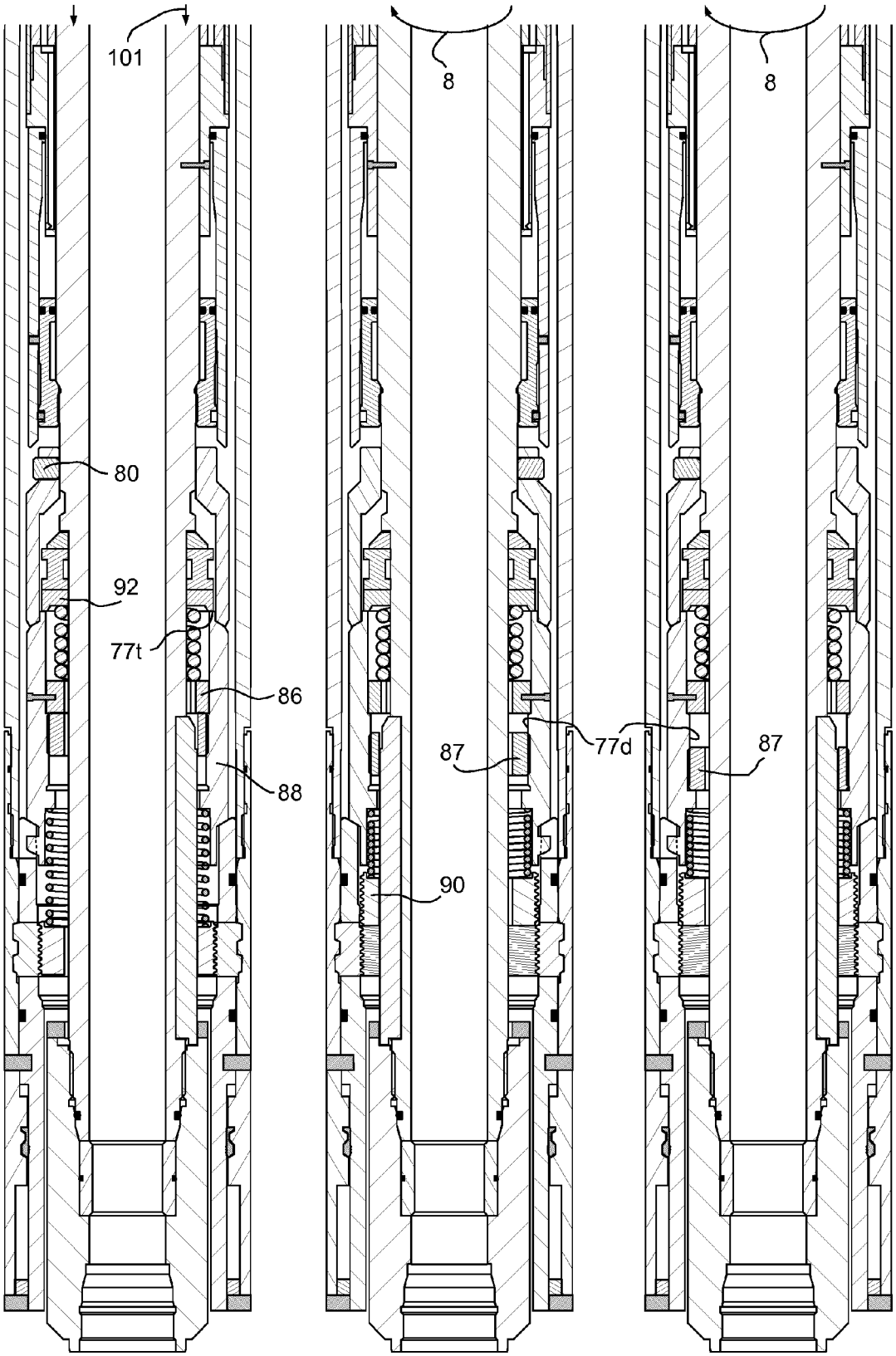

The lock sleeve 81 may have an upper portion disposed along an outer surface of the inner body section 65*i* and an enlarged lower portion. The lock sleeve 81 may have an opening formed through a wall thereof to receive the dog 80 therein. The dog 80 may be radially movable between the retracted position (shown) and an extended position (FIG. 4D). In the retracted position, the dog 80 may extend into a groove formed in an outer surface of the inner body section 65*i*, thereby fastening the lock sleeve 81 to the body 65. The groove may have a tapered upper end for pushing the dog 80 to the extended position in response to relative longitudinal movement therebetween.

The clutch 68 may include a biasing member, such as upper compression spring 84*u*, a thrust bearing 85, a gear 86, a lead nut 87, and a torsional coupling, such as key 88. The thrust bearing 85 may be disposed in the lock sleeve lower portion and against a shoulder formed in an outer surface of the inner body section 65*i*. A spring washer 92 may be disposed adjacent to a bottom of the thrust bearing 85 and may receive an upper end of the clutch spring 84*u*, thereby biasing the thrust bearing 85 against the body shoulder.

The inner body section 65*i* may have a torsional profile, such a keyway formed in an outer surface thereof adjacent to a lower end thereof. The key 88 may be disposed the keyway. The key 88 may be kept in the keyway by entrapment between a shoulder formed in an outer surface of the lower body section 65*i* and a shoulder formed in an upper end of the lower body section 65*b*.

The gear 86 may be connected to the thrust cap 77, such as by a threaded fastener 89*b*, and have teeth formed in an inner surface thereof. Subject to the lock 67, the gear 86 and thrust cap 77 may be movable between an upper position (FIG. 4D) and a lower position (shown). In the lower position, the gear teeth may mesh with the key 88, thereby torsionally connecting the thrust cap 77 to the body 65. The lead nut 87 may be engaged with the lead screw 77*d* and have a keyway formed in an inner surface thereof and engaged with the key 88, thereby longitudinally connecting the lead nut and the thrust cap 77 while providing torsional freedom therebetween and torsionally connecting the lead nut and the body 65 while providing longitudinal freedom therebetween. A lower end of the clutch spring 84*u* may bear against an upper end of the gear 86. The thrust cap 77 and gear 86 may initially be trapped between a lower end of the lock sleeve 81 and a shoulder formed in an outer surface of the key 88.

The spring shoulder 77*s* of the thrust cap 77 may receive an upper end of the latch spring 84*b*. A lower end of the latch spring may 84*b* be received by a shoulder formed in an upper end of the float nut 90. A thrust ring 91 may be disposed between the float nut 90 and an upper end of the lower body section 65*b*. The float nut 90 may be urged against the thrust ring 91 by the latch spring 84*b*. The float nut 90 may have a thread formed in an outer surface thereof. The thread may be opposite-handed, such as left handed, relative to the rest of the threads of the workstring 9. The float nut 90 may be torsionally connected to the body 65 by having a keyway formed along an inner surface thereof and receiving the key 88, thereby providing upward freedom of the float nut relative to the body while maintaining torsional connection thereto. Threads of the lead nut 87 and lead screw 77*d* may have a finer pitch, opposite hand, and greater number than threads of the float nut 90 and packer dogs to facilitate lesser (and opposite) longitudinal displacement per rotation of the lead nut relative to the float nut.

Returning to FIGS. 2C and 2D, the upper packoff 55 may include a cap, a body, an inner seal assembly, such as a seal stack, an outer seal assembly, such as a cartridge, one or more fasteners, such as dogs, a lock sleeve, an adapter, and a detent. The upper packoff 55 may be tubular and have a bore formed therethrough. The stinger 54 may be received through the packoff bore and an upper end of the spacer 56 may be fastened to a lower end of the packoff 55. The packoff 55 may be fastened to the packer 15*p* by engagement of the dogs with an inner surface of the packer.

The seal stack may be disposed in a groove formed in an inner surface of the body. The seal stack may be connected to the body by entrapment between a shoulder of the groove and a lower face of the cap. The seal stack may include an upper adapter, an upper set of one or more directional seals, a center adapter, a lower set of one or more directional seals, and a lower adapter. The cartridge may be disposed in a groove formed in an outer surface of the body. The cartridge may be connected to the body by entrapment between a shoulder of the groove and a lower end of the cap. The cartridge may include a gland and one or more (two shown) seal assemblies. The gland may have a groove formed in an outer surface thereof for receiving each seal assembly. Each seal assembly may include a seal, such as an S-ring, and a pair of anti-extrusion elements, such as garter springs.

The body may also carry a seal, such as an O-ring, to isolate an interface formed between the body and the gland. The body may have one or more (two shown) equalization ports formed through a wall thereof located adjacently below the cartridge groove. The body may further have a stop shoulder formed in an inner surface thereof adjacent to the equalization ports. The lock sleeve may be disposed in a bore of the body and longitudinally movable relative thereto between a lower position and an upper position. The lock sleeve may be stopped in the upper position by engagement of an upper end thereof with the stop shoulder and held in the lower position by the detent. The body may have one or more openings formed therethrough and spaced around the body to receive a respective dog therein.

Each dog may extend into a groove formed in an inner surface of the packer 15*p*, thereby fastening a lower portion of the LDA 9*d* to the packer 15*p*. Each dog may be radially movable relative to the body between an extended position (shown) and a retracted position. Each dog may be extended by interaction with a cam profile formed in an outer surface of the lock sleeve. The lock sleeve may further have a taper formed in a wall thereof and collet fingers extending from the taper to a lower end thereof. The detent may include the collet fingers and a complementary groove formed in an inner surface of the body. The detent may resist movement of the lock sleeve from the lower position to the upper position.

The lower packoff 58 may include a body and one or more (two shown) seal assemblies. The body may have threaded couplings formed at each longitudinal end thereof for connection to the spacer 56 at an upper end thereof and the catcher 59 at a lower end thereof. Each seal assembly may include a directional seal, such as cup seal, an inner seal, a gland, and a washer. The inner seal may be disposed in an interface formed between the cup seal and the body. The gland may be fastened to the body, such as a by a snap ring. The cup seal may be connected to the gland, such as molding or press fit. An outer diameter of the cup seal may correspond to an inner diameter of the liner hanger 15*h*, such as being slightly greater than the inner diameter. The cup seal may oriented to sealingly engage the liner hanger inner surface in response to pressure in the LDA bore being greater than pressure in the liner string bore (below the liner hanger).

The catcher 59 may include a body and a seat for receiving the ball 43*b* and fastened to the body, such as by one or more shearable fasteners. The seat may also be linked to the body by a cam and follower. Once the ball 43*b* is caught, the seat may be released from the body by a threshold pressure exerted on the ball. Once released, the seat and ball 43*b* may swing relative to the body into a capture chamber, thereby reopening the LDA bore.

The plug release system 60 may include a launcher and the cementing plug, such as a wiper plug. The launcher may include a housing having a threaded coupling formed at an upper end thereof for connection to the lower end of the catcher 59 and a portion of a latch. The wiper plug may include a body and a wiper seal. The body may have a portion of a latch, such as an outer profile, engaged with the launcher latch portion, thereby fastening the plug to the launcher. The plug body may further have a landing profile formed in an inner surface thereof. The landing profile may have a landing shoulder, an inner latch profile, and a seal bore for receiving the dart 43*d*. The dart 43*d* may have a complementary landing shoulder, landing seal, and a fastener for engaging the inner latch profile, thereby connecting the dart and the wiper plug. The plug body may be made from a drillable material, such as cast iron, nonferrous metal or alloy, fiber reinforced composite, or engineering polymer, and the wiper seal may be made from an elastomer or elastomeric coploymer.

FIGS. 4A-4F illustrate operation of the running tool 53. Once the liner string 15 has been advanced into the wellbore 24 by the workstring 9 to a desired deployment depth and the cementing head 7 has been installed, conditioner 100 may be circulated by the cement pump 13 through the valve 41 to prepare for pumping of cement slurry 81. The ball launcher 7*b* may then be operated and the conditioner 100 may propel the ball 43*b* down the workstring 9 to the catcher 59. Once the ball 43*b* lands in the catcher seat, pumping may continue to increase pressure in the LDA bore/actuation chamber 62.

Once a first threshold pressure is reached, a piston of the liner hanger 15*h* may set slips thereof against the casing 25. Pumping may continue until a second threshold pressure is reached and the catcher seat is released from the catcher body, thereby resuming circulation of the conditioner 100. Setting of the liner hanger 15*h* may be confirmed, such as by pulling on the workstring 9. The tag launcher 44 may then be operated to launch the RFID tag 45 into the conditioner 100 and pumping continued to transport the RFID tag to the running tool 53. The tag 45 may transmit the command signal 49*c* to the antenna 74 as the tag passes thereby. The MCU may receive the command signal from the tag 45 and may operate the motor controller 72*m* to energize the motor 75*m* and drive the pump 75*p*. The pump 75*p* may inject the hydraulic fluid 76*f* into the actuation chamber 83 via the passage 76*g*, thereby pressurizing the chamber and exerting pressure on the piston 78. Once a threshold pressure on the piston 78 has been reached, the shearable fastener 82 may fracture, thereby releasing the piston 78. The piston 78 may travel upward until an upper end thereof engages a shoulder formed in an outer surface of the lower housing section 71*d*, thereby halting the movement.

The workstring 9 may then be lowered 101, thereby carrying the thrust cap 77 and lock sleeve 81 downward until the lower shoulder 77*b* engages a landing shoulder formed in an inner surface of the packer 15*p*. Continued lowering 101 of the workstring 9 may cause the packer shoulder to exert a reactionary force on the thrust cap 77 and lock sleeve 81, thereby pushing the dog 80 against the groove taper. The dog 80 may be pushed to the extended position, thereby releasing the thrust cap 77 and lock sleeve 81. Lowering 101 of the workstring 9 may continue, thereby disengaging the gear 86 from the key 88. The lowering 101 may be halted by engagement of the thrust cap upper end 77*t* with a lower end of the spring washer 92. The workstring 9 may then be rotated 8 from surface by the top drive 5 to cause the lead nut 87 to travel down the thrust cap lead screw 77*d* while the float nut 90 travels upward relative to the threaded dogs of the packer 15*p*. The float nut 90 may disengage from the threaded dogs before the lead nut 87 bottoms out in the threaded passage. The rotation 8 may be halted by the lead nut 87 bottoming out against a lower end of the lead screw 77*d*, thereby restoring torsional connection between the thrust cap 77 and the body 65.

An upper portion of the workstring 9 may then be raised and then lowered to confirm release of the running tool 53. The workstring 9 and liner string 15 may then be rotated 8 from surface by the top drive 5 and rotation may continue during the cementing operation. Cement slurry (not shown) may be pumped from the mixer 42 into the cementing swivel 7*c* via the valve 41 by the cement pump 13. The cement slurry 81 may flow into the launcher 7*d* and be diverted past the dart 43*d* via the diverter and bypass passages. Once the desired quantity of cement slurry has been pumped, the cementing dart 43*d* may be released from the launcher 7*d* by operating the plug launcher actuator. Chaser fluid (not shown) may be pumped into the cementing swivel 7*c* via the valve 41 by the cement pump 13. The chaser fluid may flow into the launcher 7*d* and be forced behind the dart 43*d* by closing of the bypass passages, thereby propelling the dart into the workstring bore. Pumping of the chaser fluid by the cement pump 13 may continue until residual cement in the cement discharge conduit has been purged. Pumping of the chaser fluid 82 may then be transferred to the mud pump 34 by closing the valve 41 and opening the valve 6.

The dart 43*d* may be driven through the workstring bore by the chaser fluid until the dart lands onto the wiper plug of the plug release system 60, thereby closing a bore thereof. Continued pumping of the chaser fluid may exert pressure on the seated dart 43*d* until the wiper plug is released from the LDA 9*d*. Once released, the combined dart and wiper plug may be driven through the liner bore by the chaser fluid, thereby driving the cement slurry through the landing collar 15*c* and reamer shoe 15*s* into the annulus 48. Pumping of the chaser fluid may continue until the combined dart and wiper plug land on the collar 15*c*. Once the combined dart and wiper plug have landed, pumping of the chaser fluid may be halted and the workstring upper portion raised until the setting tool 52 exits the PBR 15*r*. The workstring upper portion may then be lowered until the setting tool 52 lands onto a top of the PBR 15*r*. Weight may then be exerted on the PBR 15*r* to set the packer 15*p*. Once the packer 15*p* has been set, rotation 8 of the workstring 9 may be halted. The LDA 9*d* may then be raised from the liner string 15 and chaser fluid circulated to wash away excess cement slurry. The workstring 9 may then be retrieved to the MODU 1*m*.

Alternatively, the RFID tag 45 may be embedded in the ball 43*b*, such as in a periphery thereof, thereby obviating the need for the tag launcher 44 and the MCU may operate the actuator after a predetermined period of time sufficient for setting of the liner hanger 15*h* and operation of the catcher 59. In a further variant of this alternative, the electronics package 72 may include a pressure sensor in fluid communication with the body bore and the MCU may operate the actuator 75 once a predetermined pressure has been reached (after receiving the command signal) corresponding to the second threshold pressure. Alternatively, the electronics package may include a proximity sensor instead of the antenna and the ball may have targets embedded in the periphery thereof for detection thereof by the proximity sensor.

Figure 5A:
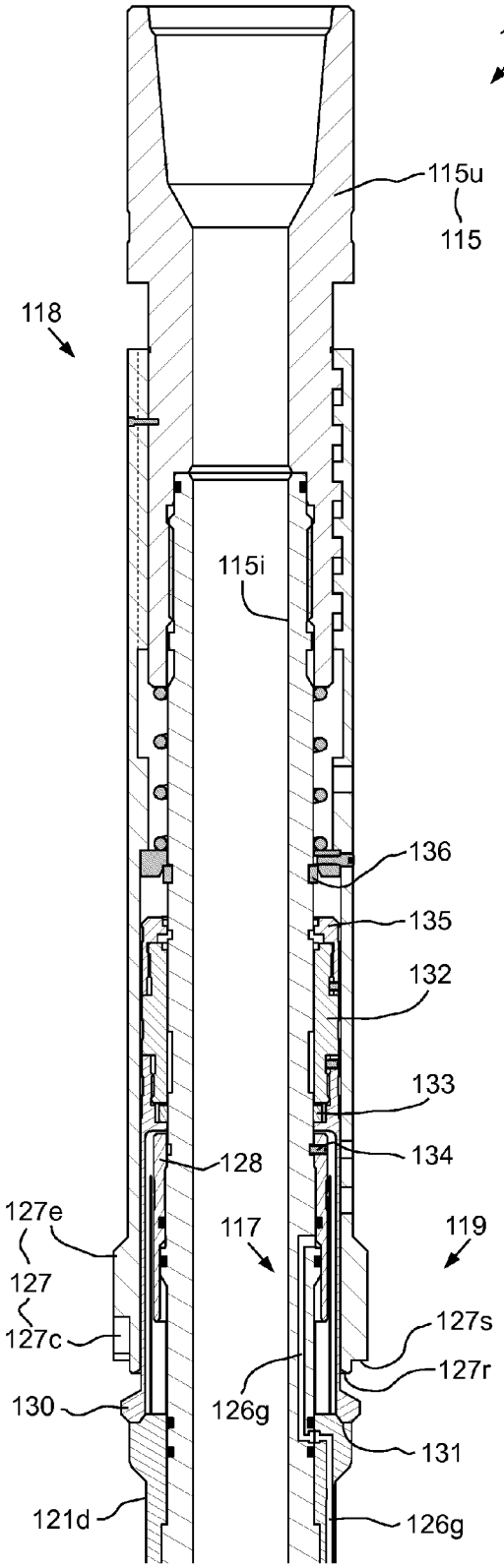
FIGS. 5A and 5B illustrate an alternative running tool for use with the LDA, according to another embodiment of this disclosure.
Figure 5B:
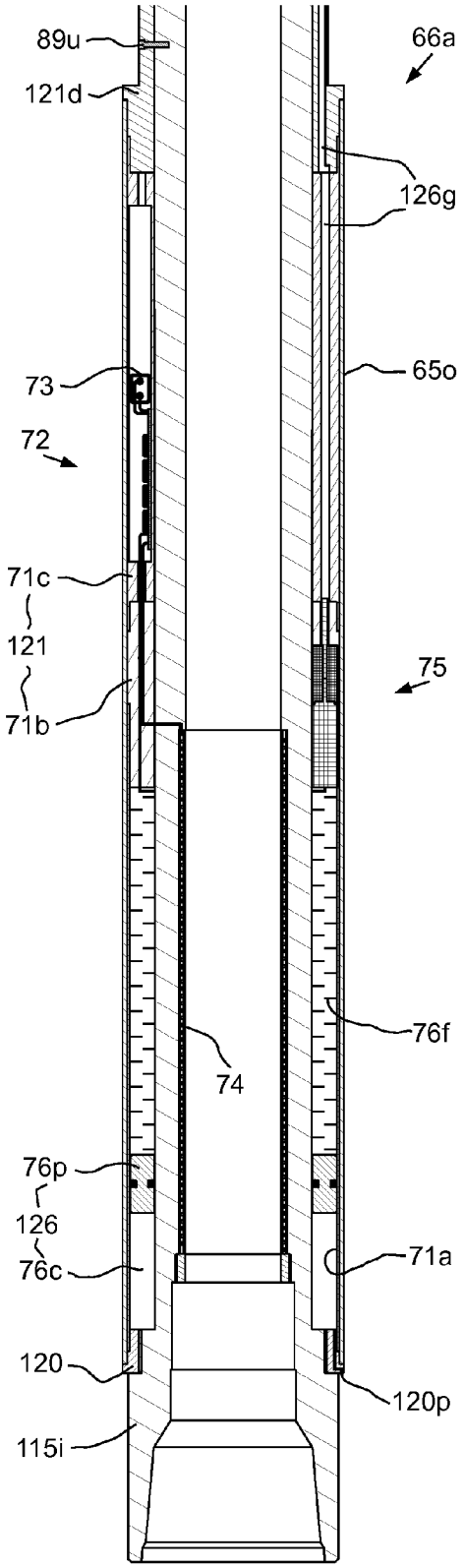

FIGS. 5A and 5B illustrate an alternative running tool 110 for use with the LDA 9*d*, according to another embodiment of this disclosure. The running tool 110 may be used with the LDA 9*d* instead of the running tool 53. The running tool 110 may include a body 115, a controller 66*a*, a release 117, an override 118, and a latch 119. The body 115 may have a bore formed therethrough and include two or more tubular sections 115*u,i*, 650. An inner body section 115*i* may be connected to an upper body section 115*u*, such as by threaded couplings. A fastener, such as a threaded nut 120, may be connected to a threaded coupling formed in an outer surface of the inner body section 115*i* and may receive an upper end of the outer housing section 65*o*. The body 115 may also have threaded couplings formed at each longitudinal end thereof for connection to the setting tool 52 at an upper end thereof and the stinger 54 at a lower end thereof.

The controller 66*a* may include a housing 121, the electronics package 72, a power source, such as the battery 73, the antenna 74, the actuator 75, and hydraulics 126. The housing 121 may have a bore formed therethrough and include two or more tubular sections 71*a-c*, 121*d*. A lower housing section 121*d* may be connected to the inner body section 115*i*, such as by the threaded fastener 89*u*. The lower housing section 121*d* may receive a lower end of the outer body section 65*o*, thereby connecting the outer body section to the inner body section 115*i*. The nut 120 may also receive an upper end of an upper housing section 71*a* and a second housing section 71*b* may receive a lower end of the upper housing section. The second housing section 71*b* may also receive an upper end of a third housing section 71*c*. The lower housing section 121*d* may receive a lower end of the third housing section 71*c*, thereby connecting the housing 71 to the inner body section 115*i*.

Alternatively, the power source may be a capacitor or inductor instead of the battery 73.

The hydraulics 126 may include the reservoir chamber 76*c*, the balance piston 76*p*, hydraulic fluid, such as the oil 76*f*, and a hydraulic passage 126*g*. The balance piston 76*p* may be disposed in the reservoir chamber 76*c* formed between the upper housing section 71*a* and the inner body section 115*i* and may divide the chamber into an upper portion and a lower portion. A port 120*p* may be formed through a wall of the nut 120 and may provide fluid communication between the reservoir chamber upper portion and the buffer chamber 61. The hydraulic oil 76*f* may be disposed in the reservoir chamber lower portion. The balance piston 76*p* may carry inner and outer seals for isolating the hydraulic oil 76*f* from the reservoir chamber upper portion.

The hydraulic passage 126*g* may provide fluid communication between the actuator 75 and the release 117. A lower portion of the hydraulic passage 126*g* may be formed through a wall of the third housing section 71*c*, a mid portion of the hydraulic passage may be formed through a wall of the lower housing section 121*d*, and an upper portion of the hydraulic passage may be formed in a wall of the inner body section 115*i*. An upper end of the hydraulic passage 126*g* may be in fluid communication with a piston 128 of the release 117.

The latch 119 may longitudinally and torsionally connect the liner string 15 to an upper portion of the LDA 9*d*. The liner packer 15*p* may be slightly modified to accommodate the running tool 110 by replacing the threaded dogs with a groove. The latch 119 may include a torque sleeve 127, a longitudinal fastener, such as a collet 130, and a collet seat 131. The collet 130 may have an upper base portion and fingers extending from the base portion to a lower end thereof. The collet fingers may be radially movable between an engaged position (shown) and a disengaged position (not shown) by interaction with the torque sleeve 127 and the collet seat 131. Each collet finger may have a lug formed at a lower end thereof. The collet fingers may be cantilevered from the collet base and have a stiffness urging the lugs toward the engaged position. The collet seat 131 may receive the lugs in the engaged position, thereby locking the fingers in the engaged position. The torque sleeve 127 may be connected to the upper housing section 115*u*, such as by bayonet couplings, and have an enlarged lower portion 127*e*. The enlarged lower portion 127*e* may have a torsional fastener, such as castellation profile 127*c* formed in an outer surface thereof. A bottom of the castellation profile may serve as a landing shoulder 127*s*. A lower end of the torque sleeve may have a release profile 127*r* formed therein.

The release 117 may include the piston 128, a shoulder formed in an outer surface of the inner housing section 115*i*, the release profile 127*r*, a keeper 132, a detent, a shearable fastener 134, a cap 135, and a stop 136. The release shoulder may carry an outer seal. The outer seal may isolate an interface formed between the release shoulder and the piston 128. The piston 128 may be longitudinally movable relative to the body 115 between an upper position (not shown) and a lower position (shown). The piston 128 may initially be fastened to the inner housing section 115*i* by the shearable fastener 134. The piston 128 may carry an inner seal for isolating an interface formed between the inner housing section 115*i* and the piston. An actuation face of the piston 128 may be formed between the inner and outer seals and may be in fluid communication with the hydraulic passage upper end. The keeper 132 may be connected to the collet 130, such as by a threaded coupling formed in an upper end of the collet base and a threaded coupling formed in a lower end of the keeper. The threaded connection may be secured by a threaded fastener.

The detent may include a fastener, such as a snap ring 133, and a complementary groove formed in an outer surface of the inner housing section 115*i*. The snap ring 133 may be radially displaceable between an extended position (shown) and a retracted position (not shown) and may be biased toward the retracted position. The collet base may have a recess formed in an inner surface thereof for receiving the snap ring 133. The snap ring 133 may be trapped between a shoulder of the recess and a lower end of the keeper 132, thereby connecting the snap ring to the collet base and the keeper. The cap 135 may be connected to the keeper 132, such as by a threaded coupling formed in an upper end of the keeper and a threaded coupling formed in a lower end of the cap. The threaded connection may be secured by a threaded fastener. The stop 136 may be a fastener, such as a snap ring, carried in a groove formed in an outer surface of the inner housing section 115*i*. The cap 135 may have a groove formed in an upper end thereof for engagement with the stop 136.

In operation, the MCU may receive the command signal from the RFID tag 45 in a similar fashion to that discussed above for the running tool 53. The MCU may then operate the motor controller to energize the motor and drive the pump of the actuator 75. The actuator pump may inject the hydraulic fluid 76*f* through the passage 126*g* and to the piston face, thereby exerting pressure on the piston 128. Once a threshold pressure on the piston 128 has been reached, the shearable fastener 134 may fracture, thereby releasing the piston. The piston 128 may travel upward and engage the collet base. The piston may 128 continue upward movement while carrying the collet 130, keeper 132, and cap 135 upward until the collet lugs engage the release profile 127*r*, thereby pushing the fingers radially inward. During upward movement of the piston 128, the snap ring 133 may align and enter the detent groove, thereby preventing reengagement of the collet lugs. Movement of the piston 128 may continue until the cap 135 engages the stop 136, thereby ensuring complete disengagement of the collet fingers.

The override 118 may include the bayonet couplings, a shearable fastener, a biasing member, such as a compression spring, and a spring washer. In the event that the liner string 15 becomes stuck in the wellbore 24 during deployment, the override 118 may be operated to release the collet 130 from the liner packer 15*p*. The override 118 may be operated by setting down weight of the workstring 9 onto the stuck liner string 15, thereby releasing the collet lugs from the seat 131 and fracturing the shearable fastener. The workstring 9 may then be rotated, thereby rotating the inner housing section 115*i* relative to the torque sleeve 127 and releasing the bayonet joint. The workstring 9 and liner deployment assembly may then be retrieved from the wellbore 24.

Alternatively, the setting tool 53 may include the override 118. Alternatively, the setting tool 53 and/or the setting tool 110 may include a hydraulic override. The hydraulic override may include a port connecting the hydraulic passage to a bore of the setting tool and closed by a pressure relief device, such as a rupture disk. Should the controller fail to operate the setting tool, a pump down plug, such as a ball, may be launched and the LDA 9*d* may include an override seat for receiving the ball. Once caught, pressure in the LDA bore may be increased until the rupture disk bursts and the bore pressure may then be used to operate the setting tool. Alternatively, either controller may be used as an override and the respective setting tool may be primarily operated using the ball 43*b*.

While the foregoing is directed to embodiments of the present disclosure, other and further embodiments of the disclosure may be devised without departing from the basic scope thereof, and the scope of the invention is determined by the claims that follow.

The invention claimed is:

1. A running tool for deploying a tubular string into a wellbore, comprising:

a tubular body;

a latch for releasably connecting the tubular string to the body and comprising:

a longitudinal fastener for engaging a longitudinal profile of the tubular string; and a torsional fastener for engaging a torsional profile of the tubular string;

a clutch selectively connecting the latch to the tubular body;

a lock movable between a locked position and an unlocked position, the lock keeping the latch engaged in the locked position;

an actuator operable to at least move the lock from the locked position to the unlocked position; and an electronics package in communication with the actuator for operating the actuator in response to receiving a command signal.

2. The running tool of claim 1, further comprising an antenna disposed in the body and in communication with a bore of the running tool for receiving the command signal.

3. The running tool of claim 1, wherein:

the longitudinal fastener is a nut torsionally connected to the body, and the clutch for selectively torsionally connecting the torsional fastener to the body.

4. The running tool of claim 3, further comprising a compression spring disposed between the nut and the clutch and biasing the nut into engagement with the body.

5. The running tool of claim 3, wherein:

the actuator comprises an electric motor and a pump, and the lock comprises a piston fastening the clutch to the body.

6. The running tool of claim 3, wherein:

the latch further comprises a thrust cap having the torsional fastener, the clutch comprises a gear fastened to the thrust cap and torsionally connecting the thrust cap to the body in an engaged position, and the thrust cap further has a shoulder formed in an outer surface thereof for engaging the tubular string such that the clutch disengages in response to longitudinal movement of the body relative to the thrust cap.

7. The running tool of claim 6, wherein:

the nut has a first thread formed in an outer surface thereof, the thrust cap has a lead screw formed in an inner surface thereof, the clutch further comprises a lead nut having a second thread formed on an outer surface thereof engaged with the lead screw, and the second thread has a finer pitch, opposite hand, and greater number than the first thread.

8. A liner deployment assembly (LDA), for hanging a liner string from a tubular string cemented in a wellbore, comprising:

a setting tool operable to set a packer of the liner string;

the running tool operable to longitudinally and torsionally connect the liner string to an upper portion of the LDA, wherein the running tool comprises:

a tubular body;

a latch for releasably connecting the liner string to the body and comprising:

a longitudinal fastener for engaging a longitudinal profile of the tubular string; and a torsional fastener for engaging a torsional profile of the tubular string;

a lock movable between a locked position and an unlocked position, the lock keeping the latch engaged in the locked position;

an actuator operable to at least move the lock from the locked position to the unlocked position; and an electronics package in communication with the actuator for operating the actuator in response to receiving a command signal;

a stinger connected to the running tool;

a packoff sealing against an inner surface of the liner string and an outer surface of the stinger and connecting the liner string to a lower portion of the LDA;

a spacer connected to the packoff; and a plug release system connected to the spacer.

9. A running tool for deploying a tubular string into a wellbore, comprising:

a tubular body;

a latch for releasably connecting the tubular string to the body and comprising:

a longitudinal fastener for engaging a longitudinal profile of the tubular string;

a torsional fastener for engaging a torsional profile of the tubular string;

a release operable to disengage the longitudinal fastener from the longitudinal profile of the tubular string;

an actuator operable to engage the release with the longitudinal fastener; and an electronics package in communication with the actuator for operating the actuator in response to receiving a command signal.

* * * * *